United States Patent [19]

Nakamura

[11] Patent Number: 4,593,160

[45] Date of Patent: Jun. 3, 1986

[54] PIEZOELECTRIC SPEAKER

[75] Inventor: Takeshi Nakamura, Uji, Japan

[73] Assignee: Murata Manufacturing Co., Ltd., Japan

[21] Appl. No.: 707,602

[22] Filed: Mar. 4, 1985

[30] Foreign Application Priority Data

Mar. 9, 1984 [JP] Japan ..... 59-46230

[51] Int. Cl.[4] ..... H04R 17/00

[52] U.S. Cl. ..... 179/110 A; 310/324; 367/157; 367/165

[58] Field of Search ..... 179/110 A; 381/114; 310/322, 324; 367/157, 160, 162, 163, 165

[56] References Cited

U.S. PATENT DOCUMENTS

| | | | |
|---|---|---|---|
| 3,761,956 | 9/1973 | Takahashi et al. | 310/324 |
| 4,379,211 | 4/1983 | Joscelyn et al. | 179/110 A |
| 4,430,529 | 2/1984 | Nakagawa et al. | 179/110 A |

FOREIGN PATENT DOCUMENTS

| | | | |
|---|---|---|---|
| 59-10098 | 1/1984 | Japan | 179/110 X |
| 59-32297 | 2/1984 | Japan | 179/110 A |

*Primary Examiner*—Gene Z. Rubinson

*Assistant Examiner*—Danita R. Byrd

*Attorney, Agent, or Firm*—Ostrolenk, Faber, Gerb & Soffen

[57] ABSTRACT

A piezoelectric speaker comprises a piezoelectric vibrator (1) for vibrating in a bending mode, which is supported at its longitudinal intermediate position by a support member (6), whereby first and second portions (1*a*, 1*b*) of the piezoelectric vibrator (1) on both sides of the support member (6) are respectively supported in a cantilever manner. The piezoelectric vibrator (1) is connected at portions close to both ends thereof with a diaphragm (8) by coupling members (12) formed by wires, whereby bending vibration of the piezoelectric vibrator (1) is transferred to the diaphragm (8) thereby to drive the diaphragm (8). The position of the support member (6) with respect to the piezoelectric vibrator (1) is so selected that the resonance frequency of the first portion (1*a*) is smaller than the corresponding resonance frequency of the second portion (1*b*), and the primary resonance frequency (f1) of the second portion (1*b*) is so selected as to be substantially at the center value of the first resonance frequency F1) and the second resonance frequency (F2) of the first portion (1*a*) on logarithmic coordinates.

9 Claims, 4 Drawing Figures

PIEZOELECTRIC SPEAKER

BACKGROUND OF THE INVENTION

The present invention relates to a piezoelectric speaker, and more particularly, it relates to improvements made on the frequency characteristic of a piezoelectric speaker.

As an example of a conventional piezoelectric speaker, there has been provided one employing a piezoelectric vibrator of cantilever configuration in which an end of, e.g., a piezoelectric bimorph element is fixed while the other end thereof is made free to be connected with a diaphragm through an appropriate coupling member thereby to vibrate the diaphragm.

However, such conventional piezoelectric speaker of the aforementioned type has the following disadvantages: First, relatively sharp resonance peaks are developed in the piezoelectric vibrator to deteriorate its frequency characteristic. Further, when some damping processing is performed to control the resonance peaks, the sound pressure level is lowered in turn.

SUMMARY OF THE INVENTION

Accordingly, an object of the present invention is to provide a piezoelectric speaker which can supply an excellent frequency characteristic without lowering the sound pressure level.

The present invention is directed to a piezoelectric speaker in which a piezoelectric vibrator vibrating in a bending mode is supported at its longitudinal intermediate position by a support member, whereby first and second portions of the piezoelectric vibrator on both sides of the support member are respectively supported in a cantilever manner, and the said piezoelectric vibrator is connected at portions close to both ends thereof with a diaphragm whereby bending vibration of the piezoelectric vibrator is transferred to the diaphragm thereby to drive the same.

The present invention is characterized in that the position of the support member with respect to the piezoelectric vibrator is so selected that the resonance frequency of the said first portion is smaller than the corresponding resonance frequency of the second pdrtion, and the primary resonance frequency of the second portion is so selected as to be substantially at the center value between the primary and secondary resonance frequencies of the first portion on logarithmic coordinates.

According to the present invention, provided for one piezoelectric vibrator are two cantilever-formed vibrator members, i.e., the aforementioned first and second portions, respective resonance frequencies of which can arbitrarily be selected depending on the position of the support member with respect to the piezoelectric vibrator. In such a manner, the position of the support member with respect to the piezoelectric vibrator is selected such that the resonance frequency of the first portion is smaller than the corresponding resonance frequency of the second portion. Further, the primary resonance frequency of the second portion is so selected as to be substantially at the center value of the primary and secondary resonance frequencies of the first portion on the logarithmic coordinates, and hence the overall frequency characteristic is made flat in view of the vibration system of the entire piezoelectric vibrator. This is because respective peaks and valley points in the frequency characteristic of the first portion are overlapped with those in the frequency characteristic of the second portion, thereby to flatten the overall frequency characteristic of the entire piezoelectric vibrator.

The above and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
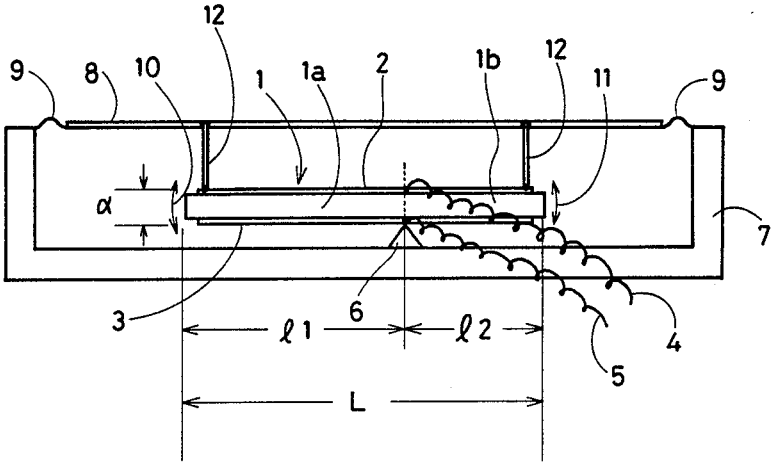
FIG. 1 is a cross-sectional view showing an embodiment of the present invention.
Figure 2:
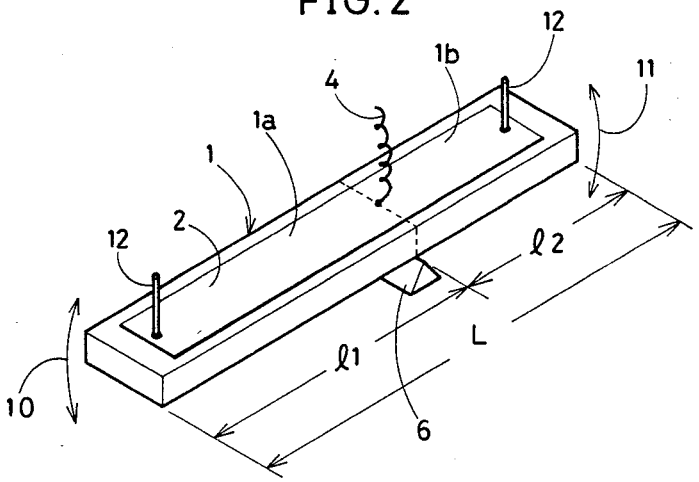
FIG. 2 is a perspective view of a piezoelectric vibrator 1 as shown in FIG. 1.

FIG. 1 shows an embodiment of the present invention in section, and FIG. 2 is a perspective view showing a piezoelectric vibrator 1 as shown in FIG. 1.

The piezoelectric vibrator 1 is shown as a longitudinal series-type piezoelectric bimorph element. The piezoelectric vibrator 1 has, when viewed from the outside, electrodes 2 and 3 respectively on its front and back surfaces. When a driving voltage is applied between the electrodes 2 and 3 through lead wires 4 and 5, the entire piezoelectric vibrator 1 vibrates in a bending mode. Such piezoelectric vibrator 1 is supported at its longitudinal intermediate position by a support member 6 which is, e.g., triangular in section, to be retained in a frame 7. A diaphragm 8 is supported by the frame 7 through a corrugated member 9 to extend in parallel with the piezoelectric vibrator 1. The corrugated member 9 is so provided that vibration of the diaphragm 8 is not prevented by the frame 7.

The piezoelectric vibrator 1 is supported by the support member 6 in the aforementioned manner, whereby a first portion 1*a* and a second portion 1*b* of the piezoelectric vibrator 1, divided at the portion supported by the support member 6 as indicated by the broken line, are respectively supported in a cantilever manner. Therefore, when the entire piezoelectric vibrator 1 vibrates in a bending mode, the first and second portions 1*a* and 1*b* vibrate as shown by arrows 10 and 11 respectively. Thus, each of the first portion 1*a* and the second portion 1*b* has its own frequency characteristic. The frequency characteristics of the both portions are controlled by the position of the support member 6, which position is selected in a manner as hereinafter described with reference to FIG. 3.

Ends of coupling members 12 are connected to the piezoelectric vibrator 1 at portions close to both ends thereof, while the other ends of the coupling members 12 are connected to the diaphragm 8. The coupling members 12 are formed by, e.g., wires. More specifically, ends of the coupling members 12 are connected with the electrode 2 by soldering or bonding, while the other ends of the coupling members 12 are connected with the diaphragm 8 by application of a bonding agent to holes provided in the diaphragm 8 for receiving the coupling members 12. When, as mentioned above, the coupling members 12 are formed by wires, lateral displacement of both end portions of the piezoelectric vibrator 1 in vibration can advantageously be absorbed thereby to facilitate stable transferring of the vibration to the diaphragm 8.

Figure 3:
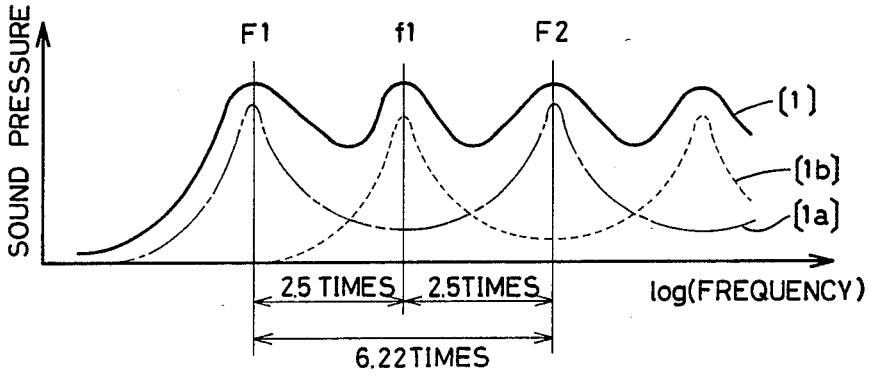
FIG. 3 is a graph showing frequency characteristics developed in the piezoelectric vibrator 1 as shown in FIGS. 1 and 2.

FIG. 3 is a graph showing the frequency characteristics developed in the piezoelectric vibrator 1. In FIG. 3, a curve shown by the one-dot chain line indicates the frequency characteristic of the first portion 1*a* and a curve shown by the broken line indicates that of the second portion 1*b* while a curve shown by the solid line indicates the overall frequency characteristic of the vibration system of the entire vibrator 1. It is to be noted that the axis of abscissa in FIG. 3 indicates the frequencies in the logarithmic scale.

Selection of the position of the support member 6 with respect to the piezoelectric vibrator 1 is now described with reference to FIGS. 1 to 3.

As shown in FIGS. 1 and 2, the length of the piezoelectric vibrator 1 is indicated by L and the thickness thereof is indicated by $\alpha$. The support member 6 is located at a position for interiorly dividing the said length L into l1 and l2. In this case, the length l1 is set to be greater than the length l2 (l1>l2) so that the resonance frequency of the first portion l*a* is smaller than the corresponding resonance frequency of the second portion 1*b*. As shown in FIG. 3, the primary resonance frequency f1 of the second portion 1*b* is so selected as to be substantially at the center value between the primary resonance frequency Fl and the secondary resonance frequency F2 of the first portion 1*a* on the logarithmic scale. More specifically along the embodiment as shown in FIGS. 1 and 2, the resonance frequency f of the cantilever-formed vibrator in bending vibration is expressed as follows:

$$f = \frac{m_i^2}{4\pi\sqrt{3}} \times \frac{d}{l^2} \sqrt{\frac{E}{\rho}}$$

in which $m_i$ represents the coefficient of i-order vibration (i=1, 2, . . . ), and the coefficient $m_1$ of the primary vibration is 1.88 and the coefficient $m_2$ of the secondary vibration is 4.69. Further, $\alpha$ indicates the thickness of the cantilever and l indicates the length thereof, while E indicates Young's modulus and $\rho$ indicates the density.

Based on the above formula, the second resonance frequency (e.g., F2) appears at a position 6.22 times the frequency value of the primary resonance frequency (e.g., F1) to develop great peaks and valley points in the sound pressure-to-frequency characteristic. For overcoming such a disadvantage, the primary resonance frequency f1 in the frequency curve [1*b*] of the second portion 1*b* is so set according to the present embodiment as to be in a position between the primary resonance frequency Fl and the secondary resonance frequency F2 in the frequency curve [1*a*] substantially at the center value on the logarithmic coordinates, i.e., at the position $\sqrt{6.22}=2.5$ times the frequency Fl. More specifically, the length l2 is expressed, from the aforementioned formula expressing the resonance frequency f, as:

$$l2 = l1/\sqrt{2.5} = l1/1.58$$

and the position for locating the support member 6 is selected to be at a point for interiorly dividing the length L in the 1.58:1 ratio, i.e., the 0.612:0.388 ratio.

The primary resonance frequency f1 of the second portion 1*b* is not necessarily selected in actual design to be exactly at the center value between the primary and secondary resonance frequencies Fl and F2 of the first portion 1*a*, so long as the primary resonance frequency fl is substantially around the said center value.

The piezoelectric vibrator 1 employed in the present invention includes, in addition to the series-type piezoelectric bimorph element as hereinabove described, a parallel-type piezoelectric bimorph element, a piezoelectric unimorph element etc., and, further, a laminated piezoelectric member as hereinafter described with reference to FIG. 4. The entire piezoelectric vibrator may be provided in any desired form so long as the same vibrates in a bending mode. It is noted here that, therefore, not necessarily employed according to the present invention is a piezoelectric vibrator of uniform configuration which has an even cross-sectional shape along the longitudinal direction, and hence the position of the support member with respect to the piezoelectric vibrator may not be regulated by the length l1 and l2 as mentioned in the foregoing description of the embodiment.

As shown in FIGS. 1 and 2, the lead wires 4 and 5 for applying the driving voltage to the piezoelectric vibrator 1 are connected with the piezoelectric vibrator 1 preferably in positions closest possible to the support member 6, so that the vibration of the piezoelectric vibrator 1 is not prevented by the lead wires 4 and 5. When the support member 6 is formed by a conductive material, the lead wire 5 may be electrically connected with the electrode 3 through the support member 6.

Figure 4:
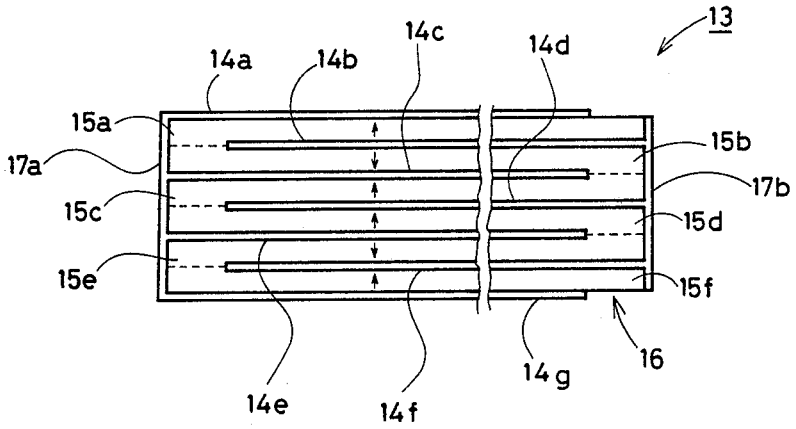
FIG. 4 is an enlarged cross-sectional view showing structure of a laminated piezoelectric member 13 according to another embodiment of the present invention.

FIG. 4 is an enlarged cross-sectional view showing structure of a laminated piezoelectric member 13 according to another embodiment of the present invention. The laminated piezoelectric member 13 comprises a sintered body 16 obtained by sintering a plurality of piezoelectric ceramic layers 15*a* to 15*f* laminated in the direction of thickness and formed with electrodes 14*a* to 14*g* opposite to each other on both sides of the respective layers and a pair of external terminals 17*a* and 17*b*. The electrodes 14*a* to 14*g* are divided into a first group of electrodes 14*a*, 14*c*, 14*e* and 14*g* and a second group of electrodes 14*b*, 14*d* and 14*f* in an alternate manner, so that those included in the first group are electrically connected with one external terminal 17*a* and those included in the second group are electrically connected with the other external terminal 17*b*. The piezoelectric ceramic layers 15*a* to 15*f* are respectively polarized in the direction of thickness, with arrows shown in the respective piezoelectric ceramic layers 15*a* to 15*f* indicating the directions of polarization.

When, in the aforementioned laminated piezoelectric member 13, a driving voltage is applied between the external terminals 17*a* and 17*b*, the upper three piezoelectric ceramic layers 15*a* to 15*c* are expanded in the surface direction while the lower three piezoelectric ceramic layers 15*d* to 15*f* are contracted in the surface direction. In other words, the upper three piezoelectric ceramic layers 15*a* to 15*c* and the lower three piezoelectric ceramic layers 15*d* to 15*f* are expanded and contracted in reverse modes. Thus, the entire piezoelectric member 13 is caused to vibrate in a bending mode.

Although one piezoelectric vibrator 1 is applied to one piezoelectric speaker in the above described embodiments, a plurality of piezoelectric vibrators may be applied to one piezoelectric speaker, if necessary.

The diaphragm 8 as shown in FIG. 1 is in the form of a flat plate, though, the same may be formed in a conical form. Further, the diaphragm 8 may be provided in any desired form in plan view selected from, e.g., square, rectangular and circular forms.

Although the present invention has been described and illustrated in detail, it is clearly understood that the same is by way of illustration and example only and is not to be taken by way of limitation, the scope of the present invention being limited only by the terms of the appended claims.

What is claimed is:

1. A piezoelectric speaker comprising a piezoelectric vibrator for vibrating in a bending mode supported at a longitudinal intermediate position thereof by a support member whereby first and second portions of said piezoelectric vibrator on both sides of said support member are supported in a cantilever manner respectively, said piezoelectric vibrator being connected at portions close to both ends thereof with a diaphragm whereby bending vibration of said piezoelectric vibrator is transferred to said diaphragm thereby to drive said diaphragm, the position of said support member with respect to said piezoelectric vibrator being so selected that the resonance frequency of said first portion is smaller than the corresponding resonance frequency of said second portion, and the primary resonance frequency of said second portion being so selected as to be substantially at the center value of the primary and secondary frequencies of said first portion on logarithmic coordinates.

2. A piezoelectric speaker in accordance with claim 1, wherein said piezoelectric vibrator includes a piezoelectric bimorph element.

3. A piezoelectric speaker in accordance with claim 1, wherein said piezoelectric vibrator includes a laminated piezoelectric member comprising a sintered body obtained by sintering a plurality of piezoelectric ceramic layers formed on both sides of respective said layers with electrodes opposite to each other and laminated in the direction of thickness, said laminated piezoelectric member being so vibrated that said piezoelectric ceramic layers in the upper region and said piezoelectric ceramic layers in the lower region are expanded and contracted in reverse modes.

4. A piezoelectric speaker in accordance with claim 1, wherein said piezoelectric vibrator and said diaphragm are coupled with each other by wires.

5. A piezoelectric speaker in accordance with claim 4, wherein said wires are connected to said diaphragm by application of a bonding agent to holes formed in said diaphragm for receiving said wires.

6. A piezoelectric speaker in accordance with claim 4, wherein said wires are connected to said piezoelectric vibrator by soldering to electrodes provided on said piezoelectric vibrator.

7. A piezoelectric speaker in accordance with claim 1 further including lead wires connected for applying a driving voltage to said piezoelectric vibrator from the outside, said lead wires being connected to said piezoelectric vibrator at positions close to said support member.

8. A piezoelectric speaker in accordance with claim 1, wherein said support member is formed by a conductive material and arranged to be in contact with electrodes for application of a voltage for driving said piezoelectric vibrator, whereby said driving voltage is supplied through said support member.

9. A piezoelectric speaker in accordance with claim 1, wherein said piezoelectric vibrator is of uniform configuration having an even cross-sectional shape along the longitudinal direction, the position of said support member with respect to said piezoelectric vibrator being selected to be close to a position interiorly dividing the longitudinal direction of said support member substantially in the 0.612:0.388 ratio.

* * * * *